United States Patent [19]

Samberg

[11] Patent Number: 4,738,016

[45] Date of Patent: Apr. 19, 1988

[54] METHOD AND APPARATUS FOR GAPPING SLIDE FASTENER CHAIN

[75] Inventor: Michael Samberg, Miami, Fla.

[73] Assignee: Talon, Inc., Meadville, Pa.

[21] Appl. No.: 20,879

[22] Filed: Mar. 2, 1987

Related U.S. Application Data

[63] Continuation-in-part of Ser. No. 848,295, Apr. 4, 1986, Pat. No. 4,663,817.

[51] Int. Cl.[4] ..... B21D 53/50; A41H 37/06

[52] U.S. Cl. ..... 29/408; 29/33.2; 29/770

[58] Field of Search ..... 29/33.2, 408–410, 29/766–770

[56] References Cited

U.S. PATENT DOCUMENTS

| | | | |
|---|---|---|---|
| 2,987,809 | 6/1961 | Burbanke | 29/770 |
| 3,812,573 | 5/1974 | Fukuroi | 29/770 |
| 4,307,499 | 12/1981 | Isalla | 29/33.2 |
| 4,490,899 | 1/1985 | Schelling | 29/770 |
| 4,510,662 | 4/1985 | Matsumoto et al. | 29/770 |
| 4,573,383 | 3/1986 | Matsumoto et al. | 29/33.2 |
| 4,589,182 | 5/1986 | Imae | 29/770 |

*Primary Examiner*—Timothy V. Eley
*Attorney, Agent, or Firm*—Anthony A. O'Brien

[57] ABSTRACT

Continuous or other lengths of flat back plastic filament coil slide fastener chain is gapped in such a manner that the tape ends produced by the gapping are scrap-free and undamaged. The slide fastener chain to be gapped is held in a laterally taut state in a die and anvil apparatus while the interengaged coil elements are forced upwardly into engagement with blades which cleanly sever the outer leg portions of the coil elements, which leg portions are conveyed upwardly by suction. During the outer leg severing operation, the slide fastener chain is further stretched laterally and caused to spread apart slightly at its center line. The center portion of the chain between the removed coil outer leg portions is received in a control and stabilizing channel between the severing blades while an ascending punch acts on the remaining interior coupling portions of the coil elements and removes them cleanly from the tapes without damaging the tapes. The removed interior coupling portions of the coil elements are also conveyed upwardly by suction away from the gapping zone. Filament coil fragments remaining near one or both ends of the gap are removed by projections on each end of the punch.

6 Claims, 4 Drawing Sheets

METHOD AND APPARATUS FOR GAPPING SLIDE FASTENER CHAIN

CROSS-REFERENCE TO RELATED APPLICATION

This application is a continuation-in-part of prior copending application Ser. No. 848,295, filed Apr. 4, 1986 for METHOD AND APPARATUS FOR GAPPING SLIDE FASTENER CHAIN which is now U.S. Pat. No. 4,663,817.

BACKGROUND OF THE INVENTION

1. Technical Field:

The present invention relates to a method of and apparatus for producing scrap-free gaps in flat back plastic filament coil slide fastener chain without damaging the tapes of the chain.

2. Description of the Prior Art:

Numerous apparatuses and methods of gapping slide fastener chain are present in the patented prior art. One example of the prior art is present in U.S. Pat. No. 3,490,133. That patent discloses a punch and die apparatus for acting on interlocked filament coil slide fastener chain to gap the chain at regular intervals by first severing outer leg portions of the coil elements and subsequently gripping and punching out the remaining interlocked interior portions of the coil elements.

The referenced patented gapping arrangement includes no provision for laterally engaging and stabilizing the central interior portions of the coil elements as they are punched, and consequently there is a possibility that, at the time of punching, the central interior coil portions may be displaced laterally due to lack of control with the result that some plastic filament scrap may remain attached to the tapes at the completion of the gapping operation. Moreover, in the patented arrangement, there is no definite provision for conveying away the severed exterior leg portions of the coil elements or the interior portions thereof, and to this extent the patented method is somewhat haphazard.

SUMMARY OF THE INVENTION

The present invention may be summarized as an apparatus and method for gapping plastic filament coil slide fastener chain of either the woven or sewn coil type wherein the chain tapes are engaged in a die apparatus and held laterally taut across a die cavity while the interlocked coils are forced upwardly into a control chamber between two blades held in the die apparatus which cleanly sever outer leg portions of the coils which are conveyed upwardly through channels of the die apparatus by suction.

As an integral part of the outer leg severing operation, the chain is further stretched laterally to slightly separate its interior tape edges. Immediately following this, an upwardly moving punch acts on the remaining interior coupling parts of the coil elements while they are being confined and controlled in said control chamber between the blades to cleanly remove all of the interior coupling parts of the coil elements from the tapes without leaving any scrap on the tapes or damaging the tapes. The removed interior coupling parts are conveyed upwardly through a channel of the die apparatus by suction.

It is the objective of the present invention to provide an improved apparatus and method for gapping woven or sewn plastic filament coil slide fastener chain wherein the drawbacks and inefficiencies of the known prior art are eliminated while a gapped slide fastener chain of better quality is produced.

A more specific object of the invention is to provide an apparatus and method of the class mentioned wherein the interlocked portions of the coil elements are fully controlled and stabilized during the punching operation which separates them from the tapes.

Still another object of the invention is to provide efficient means for conveying all of the removed coil components and scrap produced by the gapping process upwardly and away from the gapping zone.

An additional important object of the invention not realized in the above-referenced prior application and in the other known prior art is to provide means which insures that the ends of the gap are free of distorted or partially cut coil elements after completion of the gapping operation. This is accomplished effectively in the present invention by the simple provision of a pair of small spurs or teeth on the opposite ends of the punch or pusher element which cleanly remove any remaining loose coil portions or distorted coil portions in the gap area of the slide fastener chain.

Another object of the invention is to provide a gapping apparatus of greater simplicity, reliability of operation and predictability which requires no adjustment after initial set up, and which requires much less maintenance than existing prior art apparatuses. Wider slide fastener chain tolerances can be accommodated and fewer rejects and less scrap are encountered.

Other objects, advantages and features of the invention will be apparent from the following description of the preferred embodiment taken in conjunction with the accompanying drawings.

DESCRIPTION OF THE PREFERRED EMBODIMENT

Figure 1:
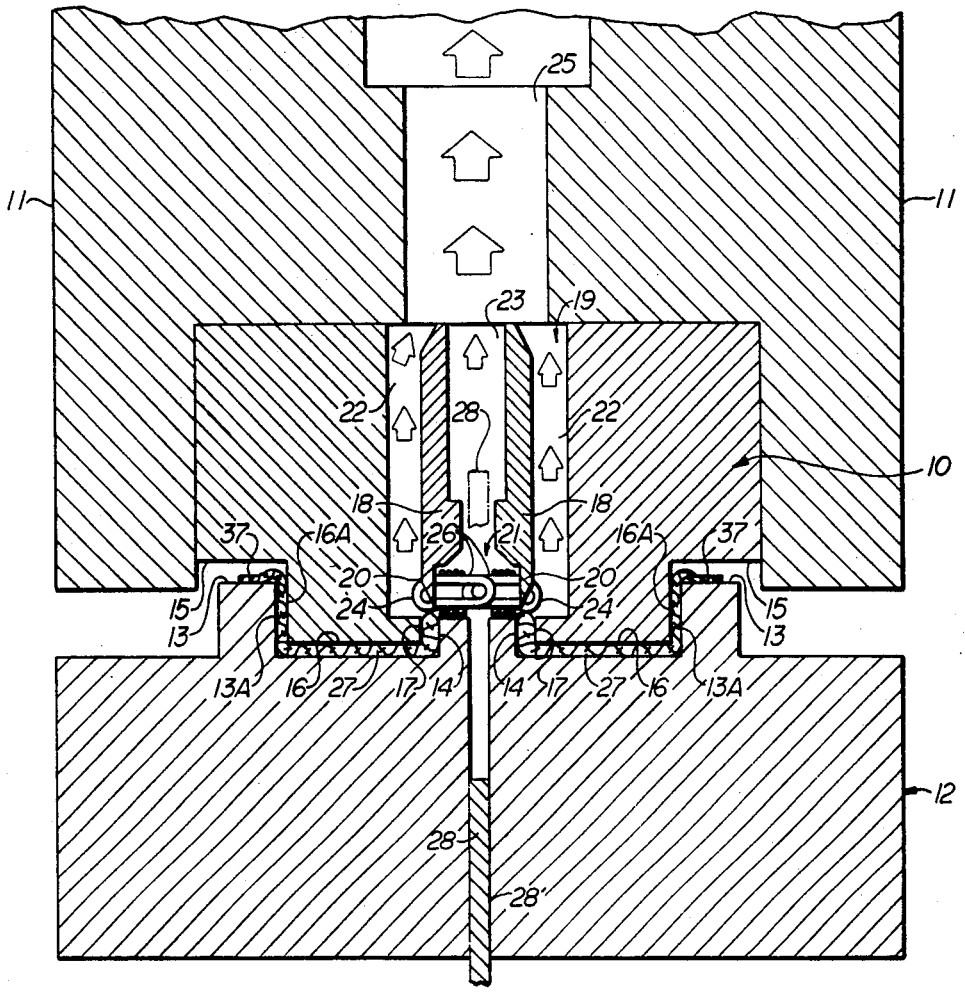
FIG. 1 is a transverse cross section taken through a die apparatus employed in the slide fastener gapping method according to the present invention.

As shown in the drawings, wherein like numerals designate like parts, a gapping apparatus particularly for flat back plastic filament coil slide fastener chain comprises a die 10 held within a die block 11 suitably secured to the machine frame. An anvil or pad 12 driven upwardly relative to the die 10 by means to be described includes a pair of outer parallel ribs 13 of equal heights and being spaced apart laterally equidistantly from the center axis of the die 10. A pair of interior more closely spaced parallel ribs 14 of lesser height is provided on the anvil 12, substantially inwardly of the ribs 13 and parallel thereto and spaced equidistantly therefrom. The interior ribs 14 are also spaced equidistantly from the center axis of the die 10.

The die 10 includes a pair of step faces 15 in a common plane opposite the faces of the anvil ribs 13 and parallel thereto. Intervening die extensions 16 interfit with the anvil ribs 13 and 14 as shown in FIG. 1. A central die cavity 17 between the extensions 16 receive the interior ribs 14 with lateral clearance.

A pair of laterally spaced cutting blades 18 is fixedly held in an evacuation passage 19 of the die 10 and these blades have leading coil severing extensions 20, beveled on their outer sides only and defining between them and immediately above the die cavity 17 a control and stabilizing chamber 21 for interior portions of the slide fastener plastic filament coils being removed in the gapping process. The interior walls of the blade extensions 20 are parallel and are spaced apart sufficiently to receive the tips of the anvil ribs 14 in the extreme upper positions of the latter.

The evacuation passage 19 includes two channels 22 on opposite sides of the blades 18 and a central channel 23 between the two blades. As will be further described, the severed outer legs 24 of the slide fastener coils are removed upwardly from the gapping station by suction in the channels 22 which lead to and communicate with a main suction passage 25 formed in the die block 11. Similarly, the interior interlocking portions 26 of the slide fastener coils are conveyed upwardly by suction through the central channel 23 following removal from the slide fastener tapes 27.

A blade-like punch 28 is relatively movable vertically with respect to the stationary die 10 and the movable anvil 12 by a common drive mechanism, soon to be described. Following severing of the outer leg portions 24, by blade extensions 20, upward movement of the punch 28 acts on the interior coil portions 26 within the control and stabilizing chamber 21 and cleanly separates them from the tapes 27 without damaging the latter.

Figure 2:
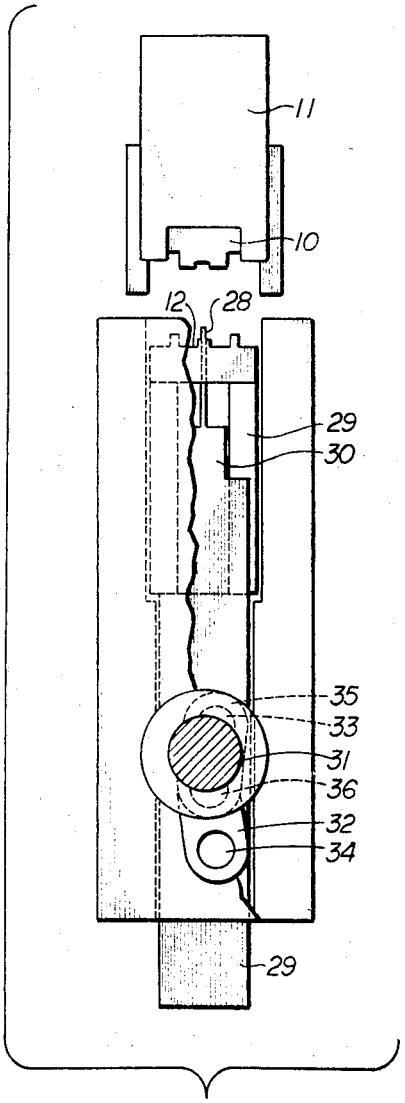
FIG. 2 is a front elevation of the gapping apparatus according to the invention including simplified drive means for the die anvil and punch.
Figure 3:
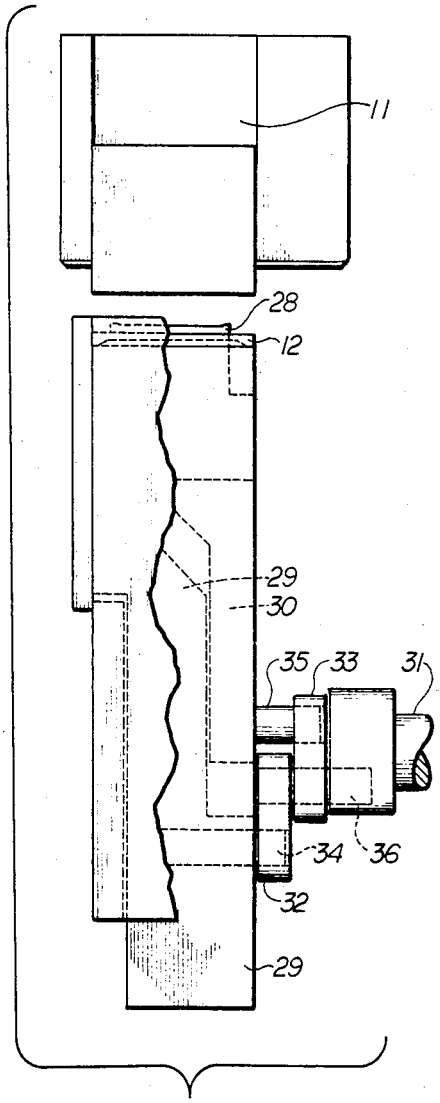
FIG. 3 is a fragmentary side elevation of the apparatus as shown in FIG. 2.

With particular reference to FIGS. 2 and 3, the anvil 12 and punch 28 are mounted, respectively, on slides 29 and 30, driven by a common crank shaft 31 through separate links 32 and 33, respectively. A single revolution clutch, not shown, causes one revolution of the crank shaft to execute the severing of the outer leg portions 24 of the coil elements and the punching and removal of the interior coil portions 26. As can be seen best in FIG. 5, the first quadrant of rotation of the crank shaft 31 will accelerate the anvil 12 upwardly while decelerating upward movement of the punch 28. The offset connecting pins 34 and 35 in the two slides 29 and 30 contribute to this relative acceleration and deceleration.

As crank pin 36 approaches the top of its stroke, the anvil or pad 12 effectively dwells in its movement. This is when the exterior coil legs 24 are severed by the stationary blades 18. During the second quadrant of crank shaft rotation, the slide 30 of punch 28 accelerates upwardly, causing the punch to push out the center coil portions 26 or scrap as the anvil 12 eases back downwardly somewhat releasing gripping pressure on the coil portions 26. The simplicity and virtue of this drive mechanism is that a single revolution of one crank shaft performs the two main steps of the gapping process according to the invention. The self-limiting motion of anvil 12 provides precisely the motion to sever the coil elements without damaging the tapes with the cutting blades.

OPERATION

Figure 4:
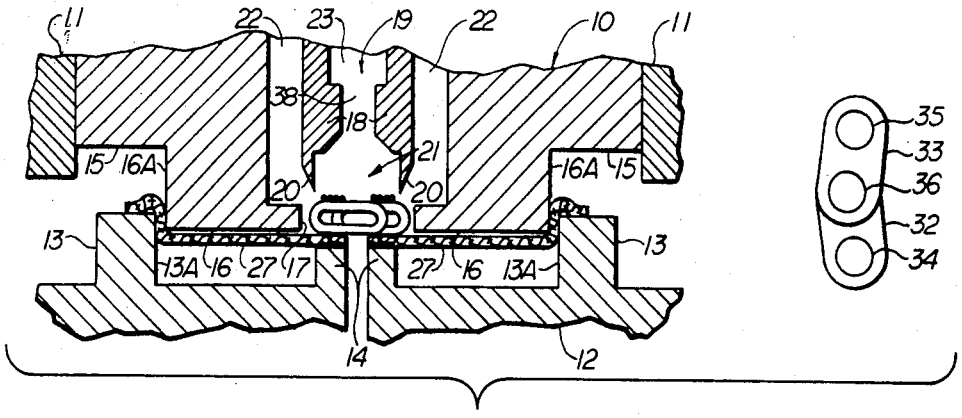
FIG. 4 is a schematic view showing an initial method step.

The closed slide fastener chain undergoing gapping is simply placed under and across the bottom of the die 10 without the need for awkward threading between close-fitting parts. The flat back coil chain is placed with its coil side up. The anvil 12 is driven upwardly to capture and pinch the two edge portions 37 of tapes 27 between the opposing side faces **13*a* of ribs 13 and 16*a* of die extensions 16, FIG. 4. This action renders the chain laterally taut across the bottom of the die 10 with the coil elements confined in the center die cavity 17**.

Figure 5:
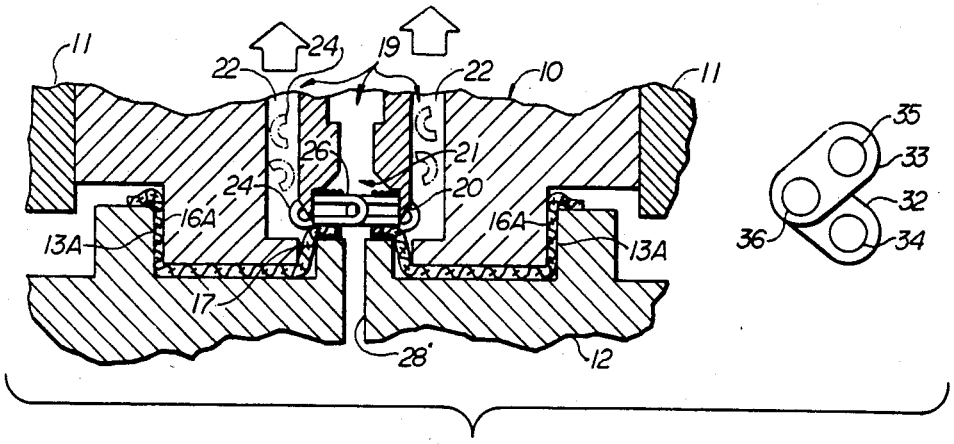
FIG. 5 is a similar view showing an intermediate method step.

As the anvil 12 continues its upward movement, the two longitudinal interior ribs 14 begin to press the coil structure upwardly in the die cavity 17 and then further upwardly into the control and stabilizing chamber 21 between blade extensions 20. As this occurs, two things take place, namely, the cutting blade extensions 20 cleanly sever the outer legs 24 of the coil structure without cutting or damaging the tapes 27, and the chain is further stretched laterally until the inner margins of the tapes are actually separated somewhat. This combined second step of the method is depicted in FIG. 5.

As previously noted, the severed coil legs or portions 24 are immediately conveyed upwardly and away from the gapping station by suction in the channels 22.

Figure 6:
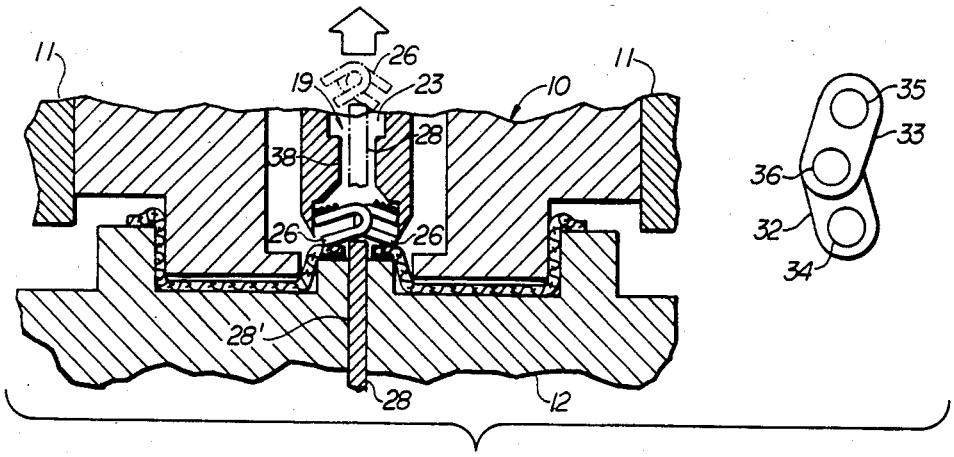
FIG. 6 is a similar view showing a final method step of the invention.

The remaining center coil portions 26 must now be separated completely from the tapes without damaging the tapes under a third and final method step shown in FIG. 6. After the severing of the leg portions 24, the anvil 12 essentially dwells and then moves downwardly slightly from its uppermost position while the punch 28, guided through a slot 28' in the anvil 12, is driven upwardly by the previously-described drive means including the single revolution shaft 31. The previous separating of the tapes 27 at the center line of the slide fastener during the second method step enables the punch 28 during its upward movement to engage and push the center coil portions 26 upwardly and out of the sewn thread or woven yarn loops, as the case may be, so as to cleanly separate the elements 26 from the tapes without damaging them or leaving any scrap attached to the tapes. The control and stabilization of the elements 26 in the chamber 21 during this activity is rather critical and necessary to allow the punch 28 to remove all of the precut elements 26 cleanly and effectively. During the removal operation, the elements 26 are firmly centralized between the two blade extensions 20 defining the control chamber 21.

The punch 28 forces the separated coil portions 26 through a slot 38 between the blades 18 and into the suction channel 23 where they are removed upwardly and away from the gapping station.

It should be noted that, in connection with the second step of the method, the cutting blade extensions 20 first make contact with the coil loops outside of the sewn or woven section. Erratic or off-center sewing of the product will not produce damage in the sewing thread or weaving yarn. The gaps produced in the chain by the apparatus and method are free of damaged thread or yarn and coil debris. Woven coil chain splices need not be removed, thus allowing continuity of the process without rethreading.

Figure 7:
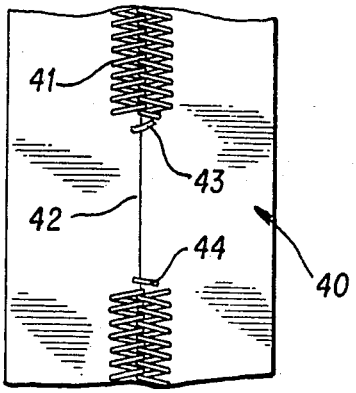
FIG. 7 is a fragmentary plan view of a slide fastener chain after a gapping operation according to the prior art.
Figure 8:
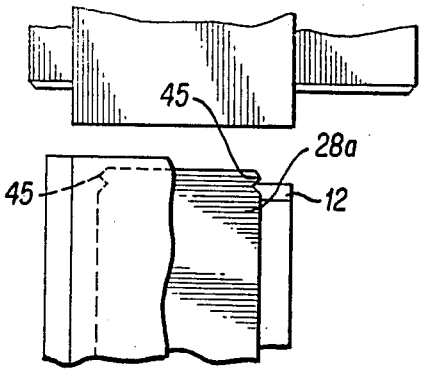
FIG. 8 is a fragmentary side elevation of a punch and associated elements according to the present invention.
Figure 9:
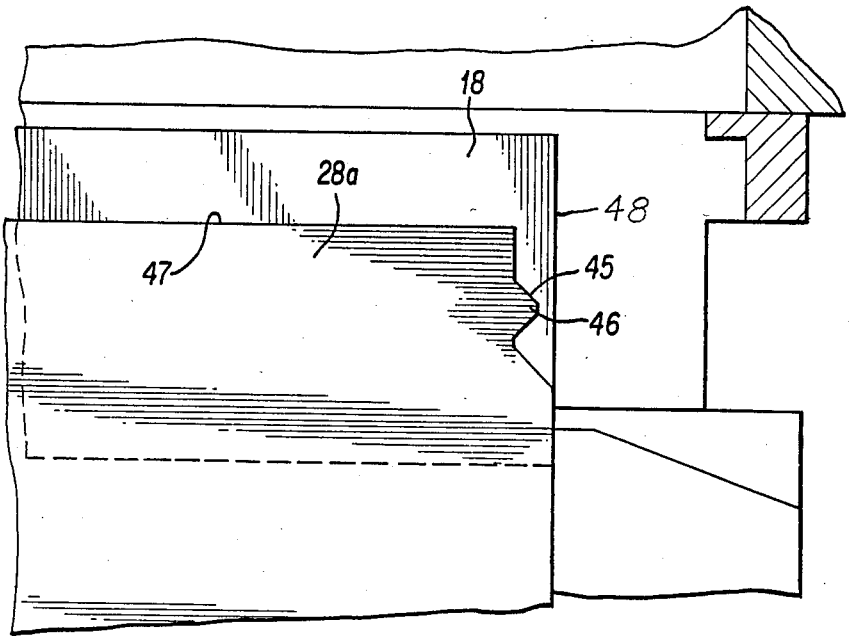
FIG. 9 is an enlarged fragmentary side elevation of the punch and associated elements, partly in section.

FIGS. 7 through 9 of the drawings show the improvement previously mentioned by means of which the ends of the gap produced in the slide fastener chain are freed of partially cut or distorted coil fragments. In FIG. 7, a slide fastener chain 40 having a filament coil 41 has been provided with a gap 42 by a prior art gapping apparatus. As sometimes occurs, at one or both ends of the gap 42, a distorted coil fragment 43 and/or a partially cut or loose coil fragment 44 may remain in place. These undesirable coil fragments interfere with subsequent slider mounting and/or top stop attaching operations.

This problem is alleviated by the present invention by the simple provision on each end of the punch or pusher 28*a* of a tapered spur or tooth 45 whose right angular apex 46 is located a slight distance below the top edge 47 of the punch 28*a* and a slight distance laterally inwardly of the adjacent vertical edge 48 of the cutting blade 18. On both the upstroke and downstroke of the improved punch 28*a*, the teeth 45 act on any coil fragments 43 or 44 present at the ends of the gap 42, FIG. 7, and remove them from the slide fastener chain so that the gap will be scrapfree without any distorted or partially cut loose coil loops. This simple means to act on and remove coil fragments at the ends of the gap is a significant feature which enhances production and reduces production costs.

Since many modifications, variations and changes in detail may be made to the above-described embodiments, it is intended that all matter described in the foregoing description or shown in the accompanying drawings be interpreted as illustrative and not in a limiting sense.

I claim:

1. A method of gapping filament coil slide fastener chain comprising the steps of engaging a slide fastener chain and holding it in a laterally taut state, forcing the filament coil structure of the chain upwardly while the chain continues to be held and thereby increasing the lateral tautness of the chain sufficiently to separate the tapes of the chain at the center thereof and substantially simultaneously severing outer leg portions of the coil structure and conveying the severed outer leg portions upwardly and away from the gapping zone, engaging remaining attached center portions of the coil structure while laterally confining and centering the same and pushing the same upwardly to effect their clean separation from the tapes and conveying the separated center portions of the coil structure upwardly and away from the gapping zone, and the additional step of engaging filament coil fragments remaining at the ends of the gap produced by the method and thereby removing said fragments.

2. An apparatus for gapping plastic filament coil slide fastener chain comprising a die having a pair of side faces and a central die cavity between said side faces, a pair of laterally spaced cutting blades fixed to said die adjacent to the die cavity and defining between the blades a control chamber for a filament coil structure of a slide fastener chain, an anvil disposed opposite said die in relatively movable relationship therewith and having first projecting parts adapted to engage said side faces of the die and second projection parts adapted to move toward the die cavity during relative movement of the die and anvil in one direction, a punch movable relative to the die and anvil and being received movably in a passage formed in the anvil and being in coaxial relationship with said die cavity and said control chamber, a common drive means for the anvil and punch operable to move the same relative to each other and relative to said die in a predetermined sequence so that the punch can engage said filament coil structure in said control chamber, means to convey filament coil scrap away from said die and cutting blades and said anvil in one direction, and means acting on filament coil fragments remaining at the ends of the gap formed by the apparatus to remove such fragments from the slide fastener chain.

3. An apparatus for gapping plastic filament coil slide fastener chain as defined in claim 2, and the last-named means comprising a tapered tooth on each end of said punch.

4. An apparatus for gapping plastic filament coil slide fastener chain as defined in claim 3, and each tooth comprising a substantially square tooth having an apex spaced a small distance inwardly of the free end of the punch and spaced a small distance laterally inwardly from the adjacent side edge of the punch.

5. In an apparatus for gapping plastic filament coil slide fastener chain, a punch coacting with a die and anvil of the apparatus and with cutting blades of the die to remove interlocking filament coil elements from the area of the slide fastener chain being gapped, and a projection on each end of the punch near the leading end of the punch to act on and remove filament coil fragments remaining attached to the slide fastener chain near the ends of the gap.

6. In an apparatus as claimed in claim 5, and each projection comprising a substantially square tooth having an apex spaced somewhat rearwardly of the leading edge of the punch and somewhat laterally inwardly of the adjacent longitudinal edge of the punch.

* * * * *